US010015865B2

(12) United States Patent
Engelen et al.

(10) Patent No.: US 10,015,865 B2
(45) Date of Patent: Jul. 3, 2018

(54) INTERACTIVE LIGHTING CONTROL SYSTEM AND METHOD

(75) Inventors: Dirk Valentinus René Engelen, Heusden-Zolder (BE); Angelique Carin Johanna Maria Kessels, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 837 days.

(21) Appl. No.: 13/522,721

(22) PCT Filed: Jan. 19, 2011

(86) PCT No.: PCT/IB2011/050226

§ 371 (c)(1),
(2), (4) Date: Jul. 18, 2012

(87) PCT Pub. No.: WO2011/092609

PCT Pub. Date: Aug. 4, 2011

(65) Prior Publication Data

US 2012/0293075 A1 Nov. 22, 2012

(30) Foreign Application Priority Data

Jan. 29, 2010 (EP) ..... 10152035

(51) Int. Cl.
*H05B 37/02* (2006.01)

(52) U.S. Cl.
CPC ..... *H05B 37/0272* (2013.01)

(58) Field of Classification Search
CPC ..... H05B 37/0272
(Continued)

(56) References Cited

U.S. PATENT DOCUMENTS 5,307,295 A * 4/1994 Taylor ..... G06F 17/5009 315/292
5,672,820 A * 9/1997 Rossi ..... G01C 21/20 348/116

(Continued)

FOREIGN PATENT DOCUMENTS

CN 201123158 Y 9/2008
CN 101341799 A 1/2009

(Continued)

OTHER PUBLICATIONS

"Orion Multiple Area Control System User's Manual", Lighting Control Philips Recall Light Effect, Jan. 1990, p. 4: Wireless Remote Controller & Handheld Programmer.

*Primary Examiner* — Darrin Dunn

(57) ABSTRACT

Interactive lighting control system (and method) for controlling and creating of light effects such as the tuning of light scenes based on location indication received from an input device. A basic idea of the claimed system is to provide an interactive lighting control by combining a location indication with a light effect driven approach in lighting control in order to improve the creating of light effects such as the tuning of light scenes especially with large and diverse lighting infrastructures. The claimed interactive lighting control system (10) comprises—an interface (12) for receiving data (14) indicating a real location (16) in a real environment from an input device (18), which is adapted to detect a location in the real environment by pointing to the location, and for receiving data related to a light effect (32) desired at the real location, and—a light effect controller (20) for mapping the real location to a virtual location of a virtual view of the real environment and determining light effects available at the virtual location.

13 Claims, 4 Drawing Sheets

(58) Field of Classification Search
USPC ..... 315/151; 362/227; 250/330
See application file for complete search history.

(56) References Cited

U.S. PATENT DOCUMENTS

| | | | | |
|---|---|---|---|---|
| 5,805,442 | A * | 9/1998 | Crater | G05B 19/4185 340/3.7 |
| 6,396,495 | B1 * | 5/2002 | Parghi | H04N 5/222 345/426 |
| 7,369,903 | B2 * | 5/2008 | Diederiks | H04L 29/06027 250/205 |
| 7,579,592 | B2 * | 8/2009 | Kaushal | 250/330 |
| 7,907,128 | B2 * | 3/2011 | Bathiche | A63F 13/00 345/173 |
| 8,159,156 | B2 * | 4/2012 | Henig | H05B 37/0254 315/294 |
| 8,494,660 | B2 * | 7/2013 | Engelen | H05B 37/029 315/312 |
| 9,041,731 | B2 * | 5/2015 | Aliakseyeu | G06F 3/011 345/619 |
| 2002/0093666 | A1 * | 7/2002 | Foote | G01S 11/12 356/621 |
| 2002/0140745 | A1 * | 10/2002 | Ellenby | G01C 21/20 715/848 |
| 2005/0275626 | A1 * | 12/2005 | Mueller | H05B 37/029 345/156 |
| 2007/0162942 | A1 * | 7/2007 | Hamynen | G06T 19/006 725/105 |
| 2007/0291483 | A1 * | 12/2007 | Lys | 362/227 |
| 2008/0024523 | A1 * | 1/2008 | Tomite | G06T 15/50 345/632 |
| 2008/0265797 | A1 * | 10/2008 | Van Doorn | H05B 37/029 315/292 |
| 2009/0066690 | A1 * | 3/2009 | Harrison | G06T 19/006 345/419 |
| 2009/0319178 | A1 * | 12/2009 | Khosravy | G06Q 30/0241 701/408 |
| 2010/0103172 | A1 * | 4/2010 | Purdy, Sr. | G06T 15/50 345/426 |
| 2010/0185969 | A1 * | 7/2010 | Wendt | H05B 37/029 715/771 |
| 2010/0244746 | A1 * | 9/2010 | Van De Sluis | H05B 37/0245 315/312 |
| 2010/0303339 | A1 * | 12/2010 | Caduff | G06F 3/011 382/154 |
| 2011/0112691 | A1 * | 5/2011 | Engelen | H05B 37/029 700/275 |
| 2011/0221963 | A1 * | 9/2011 | Bruyneel | H05B 33/0863 348/563 |
| 2011/0273114 | A1 * | 11/2011 | Ogg | H05B 37/029 315/312 |
| 2014/0343699 | A1 * | 11/2014 | Engelen | G06T 15/506 700/90 |

FOREIGN PATENT DOCUMENTS

| | | | | |
|---|---|---|---|---|
| CN | 101553061 | A | 10/2009 | |
| JP | 2009533577 | A | 10/2009 | |
| WO | 2006111934 | A1 | 10/2006 | |
| WO | 2008038188 | A2 | 4/2008 | |
| WO | 2009093161 | A1 | 7/2009 | |
| WO | WO 2010004488 | A1 * | 1/2010 | H05B 37/02 |
| WO | WO 2010139012 | A1 * | 12/2010 | |

* cited by examiner

INTERACTIVE LIGHTING CONTROL SYSTEM AND METHOD

TECHNICAL FIELD

The invention relates to interactive lighting control, particularly to the controlling and creating of light effects such as the tuning of light scenes based on location indication received from an input device, and more particularly to an interactive lighting control system and method for light effect control and creation with a location indication device.

BACKGROUND ART

Future home and current professional environments will contain a large number of light sources of different nature and type: incandescent, halogen, discharge or LED (Light Emitting Diode) based lamps for ambient, atmosphere, accent or task lighting. Every light source has different control possibilities like dimming level, cold/warm lighting, RGB or other methods that change the effect of the light source on the environment.

Almost all of the control paradigms in lighting are lamp driven: the user selects a lamp, and operates directly on the controls of the lamp by modifying the dimming value, or by operating on the RGB (Red Green Blue) channels of the lamp. While it can be very natural to adjust the lighting effect on the location directly and not be bothered by looking for the lamps that are responsible for the effect on the location.

When the number of light sources is greater than 20, it can be difficult to trace an effect on a location back to the light source. Moreover, the effect might be the result of a combination of different light effects from light sources of different natures (e.g. Ambient TL (Task Lighting) and wall washing LED lamps). In that case, the user has to play with the lighting controls of the different lamps, and has to evaluate the effect of changing them. In some cases, this effect is rather global (e.g. for ambient lighting), in some cases, this effect is very local (e.g. a spot light). So the user has to find out, which control is related to which effect, and has to find out the size of the effect in order to approach the desired light setting.

SUMMARY OF THE INVENTION

It is an object of the invention to improve the controlling of a lighting infrastructure.

The object is solved by the subject matter of the independent claims. Further embodiments are shown by the dependent claims.

A basic idea of the invention is to provide an interactive lighting control by combining a location indication device with a light effect driven approach on lighting control in order to improve the creating of light effects such as the tuning of light scenes especially with large and diverse lighting infrastructures. The effect driven approach in lighting control can be implemented by a computer model comprising a virtual representation of a real environment with a lighting infrastructure. The virtual view may be used to map a real location to a virtual location in the virtual environment. Lighting effects available at the real location can be detected and modelled in the virtual view. Both the virtual location and the available light effects may then be used to indicate to a user light effects for selection, and to calculate control settings for a lighting infrastructure. This automated and light effect driven approach may improve the controlling of a particularly complex lighting infrastructure and offers a more natural interaction, since users only have to point to the location of the real environment, where they would like to change the light effect created by the lighting infrastructure.

An embodiment of the invention provides an interactive lighting control system comprising

- an interface for receiving data indicating a real location in a real environment from an input device, which is adapted to detect a location in the real environment by pointing to the location, and for receiving data related to a light effect desired at the real location,
- a light effect controller for mapping the real location to a virtual location of a virtual view of the real environment and determining light effects available at the virtual location.

The system may further comprise a light effect creator for calculating control settings for a lighting infrastructure for creating the desired light effect on the real location based on the light effects available at the virtual location. The light effect creator may be for example implemented as a software module, which transfers light effects selected in the virtual view into light effects in the real environment. For example, when a user selects a certain location in the real environment for changing a light effect, and changes the light effect by means of the virtual view, the light effect creator may automatically process the changed light effect in the virtual view by calculating suitable control settings for creating the light effect in the real environment. The light effect creator also can take any restrictions of the lighting infrastructure in the real environment into account when creating a light effect.

The location input device may comprise one or more of the following devices:

- a first input device, which is adapted to derive the location from the detected position of infrared LEDs;
- a second input device, which is adapted to derive the location from the detected position of coded beacons;
- a light torch, which is detected by a camera;
- a laser pointer, which is detected by a camera.

Typically, a suitable input device in the context of the invention is a pointing device, i.e. a device for detecting a location to which a user points with the device.

The system may further comprise a camera and a video processing unit being adapted for processing video data received from the camera and for detecting the location in the real environment, to which the input device points, and outputting the detected real location to the mapping unit for further processing.

The interface may be adapted for receiving the data related to a light effect desired at the real location from a light effects input device.

The light effect controller may be adapted for indicating light effects available at the real location based on the virtual location in the virtual view and for transmitting available light effects to the input device, a display device, and/or an audio device for indication to a user.

The display device may be controlled such that a static or dynamic content with light effects is displayed for selection with a light effects input device.

The data related to a light effect desired at the real location can comprise one or more of the following:

- data about the size of the real location at which the desired light effect should be created;
- data about a light effect at a first real location dragged with an input device to a second real location at which the light effect should be created, too;

data about a light effect at a first real location dragged with an input device to a second real location to which the light effect should be moved;

data about a grading or fading effect in a particular area or spot.

The light effect creator may be adapted to trace back to lamps, which influence the light in the real location, of the lighting infrastructure based on the virtual location and to calculate the control settings for the lamps, which were traced back.

A further embodiment of the invention relates to an input device for a system according to the invention and as described above, wherein the input device comprises a pointing location detector for detecting a location in the real environment, to which the input device points, and a transmitter for transmitting data indicating the detected location.

The input device can further comprise light effects input means for inputting a light effect desired at the location, to which the input device points, wherein data related to a desired inputted light effect are transmitted by the transmitter.

A yet further embodiment of the invention relates to an interactive lighting control method comprising the acts of receiving data indicating a real location in a real environment from an input device, which is adapted to detect a location in the real environment by pointing to the location, and receiving data related to a light effect desired at the real location, and mapping the real location to a virtual location to a virtual view of the real environment and determining light effects available at the virtual location.

An embodiment of the invention provides a computer program enabling a processor to carry out the method according to the invention and as described above. The processor may be for example implemented in a lighting control system such as in a central controller of a lighting system.

According to a further embodiment of the invention, a record carrier storing a computer program according to the invention may be provided, for example a CD-ROM, a DVD, a memory card, a diskette, internet memory device or a similar data carrier suitable to store the computer program for optical or electronic access.

A further embodiment of the invention provides a computer programmed to perform a method according to the invention such as a PC (Personal Computer). The computer may be for example implement a central controller of a lighting infrastructure.

These and other aspects of the invention will be apparent from and elucidated with reference to the embodiments described hereinafter.

The invention will be described in more detail hereinafter with reference to exemplary embodiments. However, the invention is not limited to these exemplary embodiments.

DESCRIPTION OF EMBODIMENTS

Figure 1:
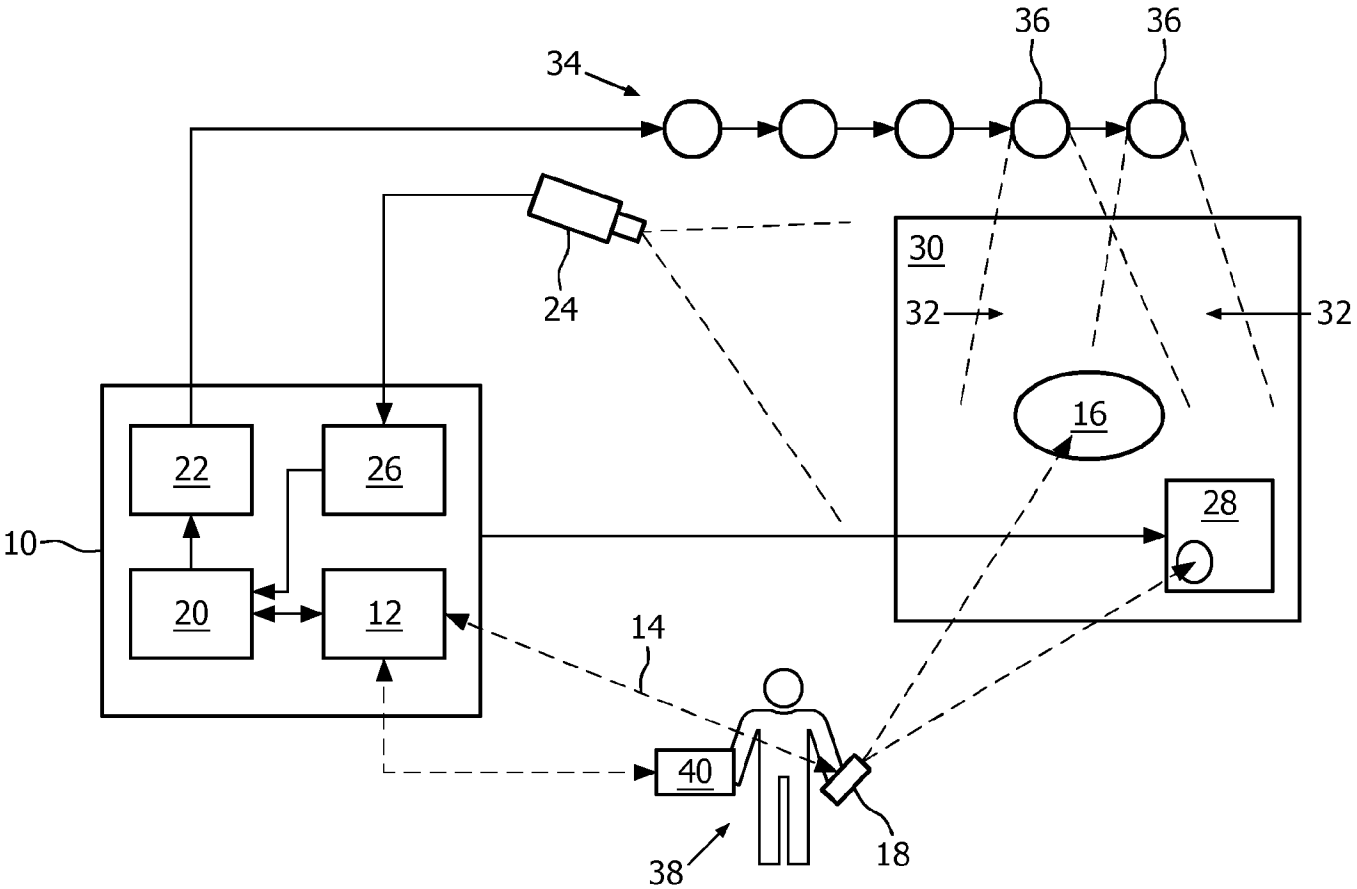
FIG. 1 shows an embodiment of an interactive lighting control system according to the invention.

In the following, functionally similar or identical elements may have the same reference numerals. The terms "lamp", "light" and "luminary" describe the same.

FIG. 1 shows an interactive lighting control system 10 comprising an interface 12, for example a wireless transceiver being adapted for receiving wirelessly data from an input device 18, a light effect controller 20, a light effect creator 22, and a video processing unit 26 for processing video data captured with a camera 24 connected to the interactive lighting system 10. The interactive lighting control system 10 is provided for controlling a lighting infrastructure 34 comprising several lamps 36 installed in a real environment such as a room with a wall 30. The system 10 may be implemented by a computer executing software implementing the modules 20, 22 and 26 of the system 10. The interface 12 may then be for example a Bluetooth™ or a WiFi transceiver of the computer. The system 10 may further be connected with a display device 28 such as a computer monitor or TV set.

Interactive control of the lighting created with the lighting infrastructure 34 may be performed by usage of the input device 18, which may be hold by a user 38. The user 38, who desires to create a certain lighting effect at a real location 16 on the wall 30, simply points with the input device 18 to the location 16. In order to detect the location 16, to which the user 38 points, the input device 18 is adapted to detect the location 16.

The input device 18 may be for example the uWand™ intuitive pointer and 3D control device from the Applicant. The uWand™ control device comprises an IR (Infrared) receiver, which detects signals from coded IR beacons, which may be located at the wall 30 besides a TV set. From the received signals and the positions of the beacons, the uWand™ control device may derive its pointing position and transmit the derived pointing position via a wireless 2.4 GHz communication link to the interface 12. The uWand™ control device makes 2D and 3D position detection possible. For example, also turning of the input device may be detected.

Also, the WiiMote™ input device from Nintendo Co., Ltd., may be used for the purposes of the present invention. The WiiMote™ input device allows a 2D pointing position detection by capturing IR radiation from IR LEDs with a built-in camera and deriving the pointing position from the detected position of IR LEDs. Transmission of data related to the detected pointing position occurs via a Bluetooth™ communication link, for example with the interface 12.

Furthermore, a laser pointer or light torch may be applied as input device, when combined with a camera for detection the pointing position in the real environment, for example on the wall 30. Data related to the detected pointing position are generated by a video processing of the pictures captured with the camera. The camera may be integrated in the input device similar to the WiiMote™ input device. Alternatively, the camera may be an external device combined with a video processing unit for detecting the pointing position. The external device comprising the camera may be either connected to or integrated in the interactive lighting control system 10, such as the camera 24 and the video processing unit 26 of the system 10.

The input device 18 wirelessly transmits data 14 indicating the location 16, to which it points in the real environment 30, to the interface 12 of the interactive lighting control system 10.

A light effect controller 20 of the interactive lighting control system 10 processes the received data 14 as follows: The real position of the location 16 is mapped to a virtual location of a virtual view of the real environment. The virtual view may be a 2D representation of the real environment such as the wall 30 shown in FIG. 1. The virtual view may be for example created by capturing the real environment with the camera 24. The virtual view may be also already stored in the interactive lighting control system 10, for example by taking a picture of the wall 30 with a digital photo camera and transferring the taken picture to the system 10.

The light effect controller 20 determines light effects available at the virtual location. This may be performed for example by means of a model of the lighting infrastructure 34 installed in the real environment, wherein the model relates the controls of the lighting infrastructure 34 to light effects and locations in the virtual view of the real environment.

The model may be created by a so called Dark Room Calibration (DRC) method, where the effect and location of every lighting control, for example a DMX channel, is measured. The light effects detected with a DRC can then be assigned to virtual locations in the virtual view to form the model. For example, a target illumination distribution can be expressed as a set of targets in discrete points, for example 500 lux on some points of a work surface, as a colorful distribution in a 2D view, for example the distribution measured on a wall, or the distribution as received by a camera or colorimetric device, or more abstractly, as a function that relates the light effect to a location.

The light effects, which are determined by the light effect controller 20 as being available at the location 16, may be displayed on the display device 28 or transmitted via the interface 12 to the input device 18 or a separate light effects input device 40, which may be for example implemented for example by a PDA (Personal Digital Assistant), a smart phone, a keyboard, a PC (Personal Computer), a remote control of for example a TV set.

A user selection of a desired light effect is transmitted from the input device 18 or the light effects input device 40 to the system 10, and via the interface 12 to the light effects controller 20, which transmits the selected light effect and the location 16 to the light effect creator 22. The creator 22 traces back to the lamps 36 of the lighting infrastructure 34, which influence the light in the location 16, calculates the control settings for the traced back lamps 36, and transmits the calculated control settings to the lighting infrastructure 34 so that the user desired light effect 32 is created by the lamps 36 at the location 16.

In the following, the selection of light effects by the user 38 will be explained by means of several use cases. In the shown use cases, the cross marks the pointing position of the input device 18 and the dashed arrows represent movements performed with the input device 18, i.e. the movement of the pointing location of the input device 18 from one to another location in the virtual view, which is a 2D representation of the real environment, for example the wall 30.

Figure 2:
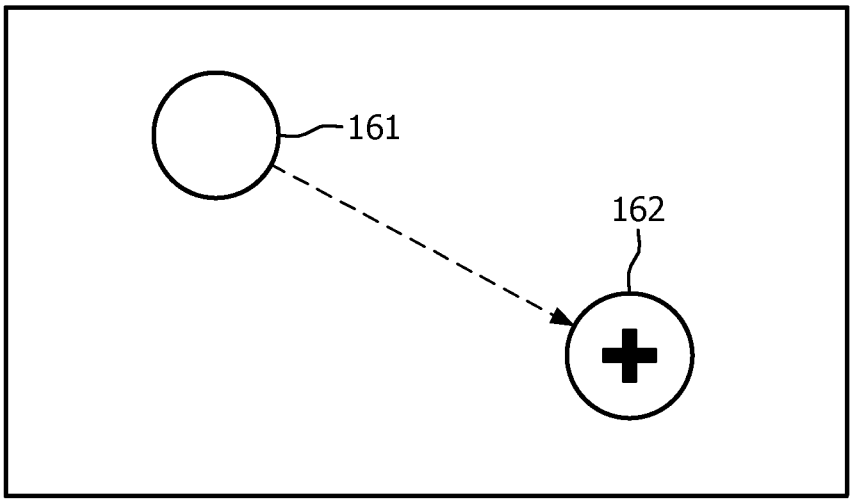
FIG. 2 shows a first use case of the interactive lighting control system according to the invention, wherein a light effect is dragged from one location to another location with an input device according to the invention.

The FIGS. 2-7 show some possible interactions between the input device 18 and the effects present in the virtual view. Because the content of the virtual view may be considered as a target light effect distribution, the lighting output may change accordingly, such that the user 38 may get an immediate feedback. This may result in an immersive fine tuning of the lighting atmosphere created by the lighting infrastructure 34:

FIG. 2 shows a use case, where a light effect is selected from one location 161 and dragged to another location 162. The desired light effect such as a spotlight is first at the location 161. The user 38 may select the desired light effect by pointing with the input device 18 to the location 161, pressing a certain button on the input device 18 and drag the so selected light effect to the new location 162, where it should be created. At the new location 162, marked with the cross, the user 38 releases the still pressed or presses the button again. The input device 18 may record the location 161 at the first button press and the location 162 at the release of the button press or the second button press and transmit both locations 161 and 162 as real location indicating data together with data related to the light effect, namely dragging the light effect on location 161 to location 162, to the system 10, which then creates the spotlight on location 161 on the new location 162. This technical process for detecting a user interaction for selecting a desired light effect for a location and transmitting the data related to this selection is also performed with the further use cases described in the following.

Figure 3:
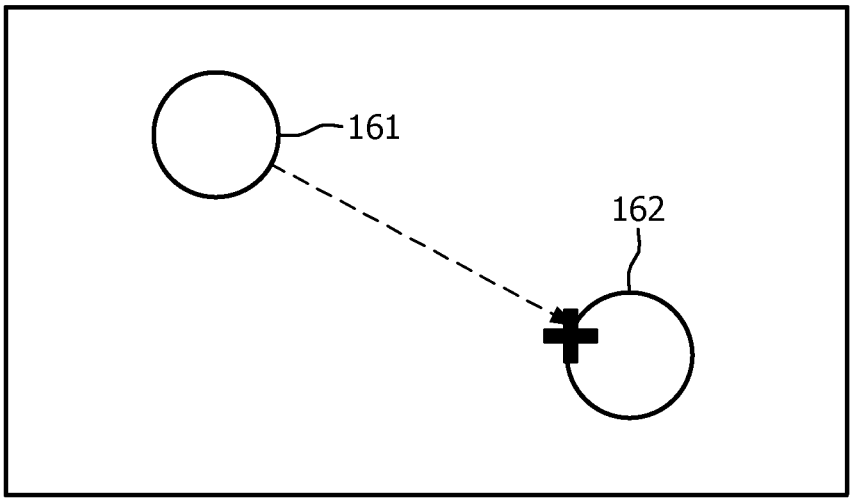
FIG. 3 shows a second use case of the interactive lighting control system according to the invention, wherein a spot from a redirect able lamp is dragged from one location to another location with an input device according to the invention.

FIG. 3 shows a use case, where a light effect such as a spotlight created with a redirect able lamp (or moving head) on a location 161 is selected and dragged to another location 162. The interaction is the same as explained with regard to the use case shown in FIG. 2. In this use case, it may be easier to place the light effect exactly at the user's desired new location 162.

Figure 4:
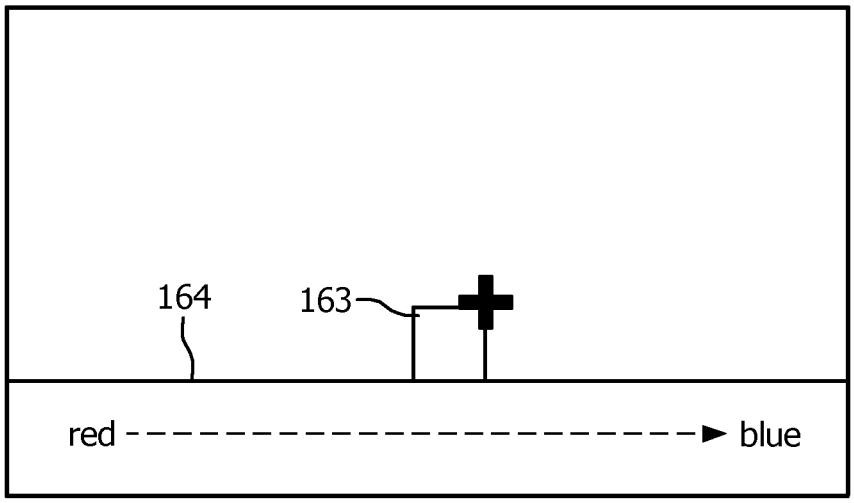
FIG. 4 shows a third use case of the interactive lighting control system according to the invention, wherein functions are provided in a virtual view to enhance interactions according to the invention.

FIG. 4 shows a use case with functions in a virtual view to enhance the interaction. In some cases, more complex lighting targets (like gradients) need to be generated. In this case, a green effect 163 may be inserted in a red to blue gradient 164. The location of the green effect affects the generation of the red→green and green→blue transition. The location of the green spot can be changed with the described drag interaction. In general, functions (like gradient generation) can be implemented in the view such that a richer interaction with the lighting system can be provided. These functions then react to the positioning of light effects in order to generate a more complex interaction.

Figure 5:
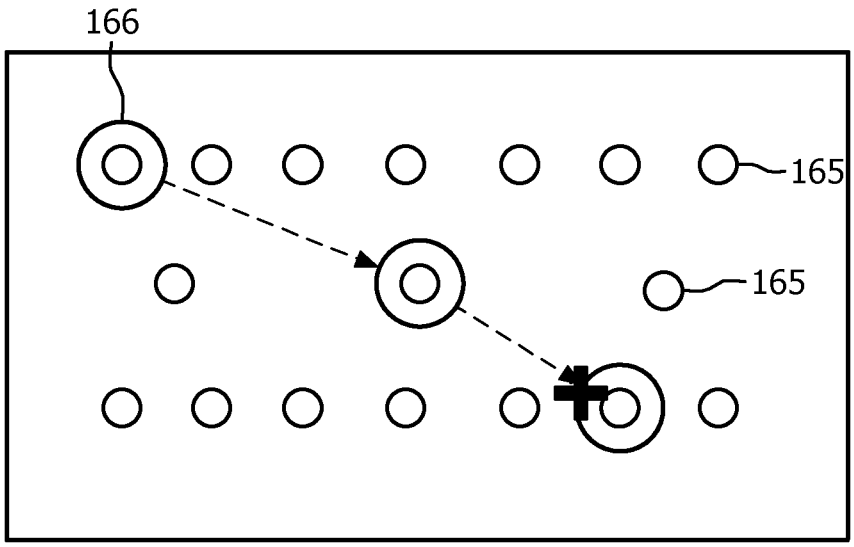
FIG. 5 shows a fourth use case of the interactive lighting control system according to the invention, wherein location attractors are provided.

FIG. 5 shows a further use case with location attractors 165. Because the system 10 knows the location of the effects and effect maxima, it can use these locations 165 as "effect attractors". When dragging a light effect 166, this will jump from attractor to attractor. This simplifies the positioning of an effect for the user, because effects are only placed on relevant places. This also enhances the immersive feedback to the user, because the location can be followed through the changes of the lighting itself. The definition of attractor is not limited to an effect maximum; also sensitive input places for functions can be relevant.

Figure 6:
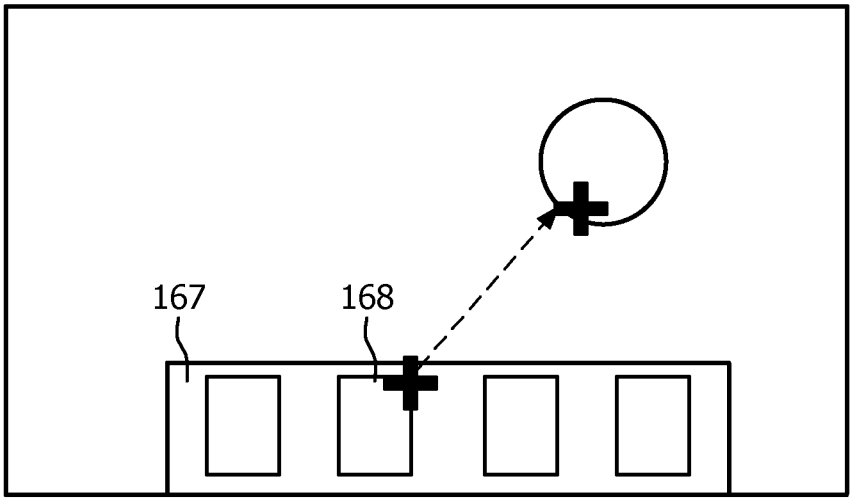
FIG. 6 shows a first embodiment of a fifth use case of the interactive lighting control system according to the invention, wherein the display device shows a static color palette.
Figure 7:
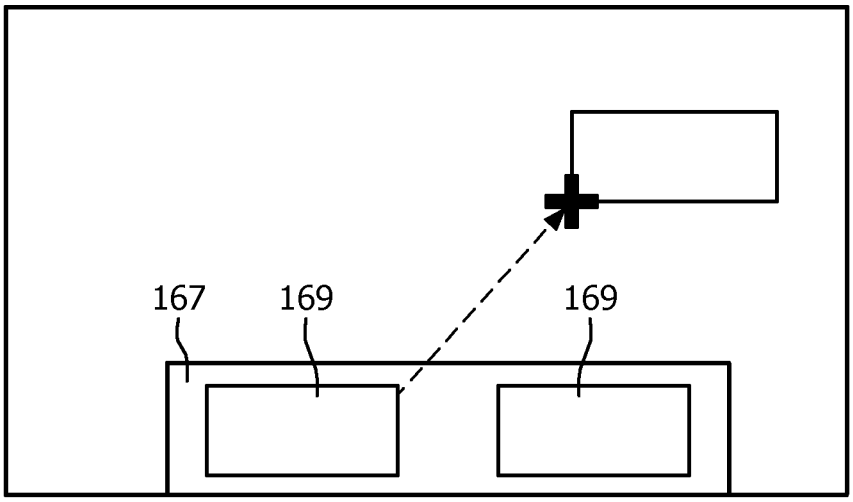
FIG. 7 shows a second embodiment of a fifth use case of the interactive lighting control system according to the invention, wherein the display device shows a dynamic color palette

FIGS. 6 and 7 show further use cases integrating a display device with a color palette 167. As described with regard to FIG. 1, in the real environment, a display device 28 can be present, which may show a color palette 167 of light effects. The palette and arrangement on the screen may be controlled by the interactive lighting control system 10. The location of the display device 28 can be integrated in the virtual view. Pointing to a color 168 of the palette 167 on the display device 28 can be detected in the virtual view, and in the view, there is no difference between the color blob on the display device and a light effect. This makes an interaction possible, similar to the use case shown in FIG. 2 and explained above: select an effect and drag it to another location. The color effect is dragged from the display device into the environment as if it was a light effect. Instead of a display device with a static color palette, it can also be a display device with some dynamic content, as shown in FIG. 7. The dynamic content can contain multiple pixels 169, and every pixel can change over time. Pixels in the dynamic content can also be mapped on to location attractors in the virtual view. Instead of a separate display device, the color palette and target color can also be displayed and selected on the input device 18 or the light effect input device 40.

When pointing at a location, a display device can give some feedback on the possibilities at those locations. For example, a triangle of colors that can be rendered at the location can be shown on the input device or a separate display device.

When multiple effects are present, the interactive lighting control system 10 can select the most influencing effect at the location the user points to. It is also possible to influence a set of effects.

Finally, as in the known interaction with mouse and pointer, the user 38 can also indicate an area in the virtual view. This will select a set of effects that are mainly present in the area. Tuning operations are then performed on the set of effects.

Tuning operations possible on the selected area may be for example

- change color temperature, hue, saturation and intensity;
- smoothen or sharpen the effects: extremes in hue/saturation/intensity are weakened or strengthened.

To indicate the size of the selected area, the lamps that have a contribution to the area can start flashing or can be set by the interactive lighting control system 10 to a contrasting light effect. This provides the user 38 with a feedback on the selected area.

On the input device 18, several interaction methods can be used for changing the light effect:

- Buttons to change the hue, saturation and intensity of the (set of) effect(s) at which it is pointed.
- These parameters can also be changed by moving the input device 18 upwards or downwards, and by using accelerometers to detect this movement.
- Buttons or other input methods can be used to perform the "drag" operation. (Needed to move effects or to select an area).
- A touch screen color circle or other arrangement which shows the hue, saturation and intensity of the pointed light effect, and which makes it possible to drive the hue, saturation and intensity to a value that satisfies the user.

When an area is selected, the shown values of hue, saturation and intensity can be average values, but also minima or maxima. In the latter case, the interaction makes it possible to change the extreme values. It is also possible to weaken or strengthen the distribution of extreme values in order to smoothen or sharpen the effect.

The invention can be used in environments where a large number of for example more than 20 luminaries is present, in future homes with a complex and diverse lighting infrastructure, in shops, public spaces, lobbies where light scenes are created, for chains of shops (one can think of a single reference shop, where light scenes are created for all shops; when the light scenes are deployed, some fine-tuning might be needed). The interaction is also useful for tuning the location of a redirect able spot. These spots are mainly used in shops (mannequins), art galleries, in theatres and on stages of concerts.

Typical applications of the invention are for example the creation of light scenes from scratch (areas are located and effects are increased from zero to a desired value), and the immersive fine-tuning of light scenes which are created by other generation methods.

At least some of the functionality of the invention may be performed by hard- or software. In case of an implementation in software, a single or multiple standard microprocessors or microcontrollers may be used to process a single or multiple algorithms implementing the invention.

It should be noted that the word "comprise" does not exclude other elements or steps, and that the word "a" or "an" does not exclude a plurality. Furthermore, any reference signs in the claims shall not be construed as limiting the scope of the invention.

The invention claimed is:

1. An interactive lighting control system, comprising:

an interface configured to receive data indicating a real location in a real environment from an input device, the real location derived by said input device based on processing of positional data obtained by pointing the input device at the real location, and wherein said interface is configured to receive data related to a light effect produced by one or more light sources desired at the real location;

a light effect controller configured to map the real location as determined by said input device to a virtual location of a virtual view of the real environment and determine light effects available by the one or more light sources at the virtual location by assigning light effects at the real location to the virtual location in the virtual view; and a light effect creator configured to control said one or more light sources by providing feedback at the real location based on the received data indicating the real location and the received data related to the light effect produced by the one or more light sources desired at the real location, said feedback comprising an indication different from the light effect produced by the one or more light sources desired at the real location, and producing said desired light effect at the real location based on the light effects available at the virtual location.

2. The system of claim 1, wherein said light effect creator is configured to calculate control settings for a lighting infrastructure to control said one or more light sources to produce the desired light effect on the real location based on the light effects available at the virtual location.

3. The system of claim 1, wherein the input device comprises one or more of the following devices:

a first input device to derive the location from the detected position of infrared LEDs;

a second input device to derive the location from the detected position of coded beacons;

a light torch, which is detected by a camera;

a laser pointer, which is detected by a camera.

4. The system of claim 1, further comprising a camera and a video processing unit configured to process video data received from the camera, to detect the location in the real environment at which the input device points, and to output the detected real location to the light effect controller for further processing.

5. The system of claim 1, wherein the interface receives the data related to a light effect desired at the real location from a light effects input device.

6. The system of claim 1, wherein the light effect controller indicates light effects available at the real location based on the virtual location in the virtual view and transmits available light effects to the input device, a display device, or an audio device for indication to a user.

7. The system of claim 6, wherein the display device is controlled such that a static or dynamic content with light effects is displayed for selection with a light effects input device.

8. The system of claim 6, wherein the data related to a light effect desired at the real location comprise one or more of the following:

data about the size of the real location at which the desired light effect should be created;

data about a light effect at a first real location dragged with an input device to a second real location at which the light effect should be created, too;

data about a light effect at a first real location dragged with an input device to a second real location to which the light effect should be moved;

data about a grading or fading effect in a particular area or spot.

9. The system of claim 6, wherein the light effect creator traces back to lamps, which influence the light in the real location of the lighting infrastructure based on the virtual location and calculates the control settings for the lamps, which were traced back.

10. The input device for the system of claim 6, comprising:

a pointing location detector configured to detect a location in the real environment, to which the input device points, and a transmitter configured to transmit data indicating the detected location.

11. The input device of claim 10, further comprising:

light effects input means configured to input a light effect desired at the location, to which the input device points, wherein data related to a desired inputted light effect are transmitted by the transmitter.

12. An interactive lighting control method, comprising the acts of:

receiving data indicating a real location in a real environment from an input device, the real location derived by processing of positional data obtained by pointing the input device at the real location, and wherein an interface is configured to receive data related to a light effect produced by one or more light sources desired at the real location;

mapping the real location as determined by said input device to a virtual location of a virtual view of the real environment and determining light effects available at the virtual location by assigning light effects at the real location to the virtual location in the virtual view; and controlling light output of said one or more light sources to provide feedback at the real location based on the received data indicating the real location and the received data related to the light effect produced by one or more light sources desired at the real location, said feedback comprising an indication different from the light effect produced by the one or more light sources desired at the real location, and produce the desired light effect at the real location.

13. An interactive lighting control system, comprising:

an interface configured to:

receive, from an input device, data indicative of first and second real locations in a real environment, said input device configured to detect a location in the real environment by pointing to said location; and receive data related to a light effect produced by one or more light sources desired at the first real location; and a light effect controller configured to map the real location as detected by said input device to a virtual location of a virtual view of the real environment, and to determine light effects available at the virtual location, said light effect controller assigning light effects at the real location to the virtual location in the virtual view; and a light effect creator configured to control said one or more light sources based on the received data indicating the first and second real locations and the received data related to the light effect and produce said desired light effect at the second real location based on the light effects available at the virtual location.

* * * * *